US005538150A

United States Patent [19]

Perkins

[11] Patent Number: 5,538,150

[45] Date of Patent: Jul. 23, 1996

[54] BOOM LATCH

[75] Inventor: Mark Perkins, Ellsworth, Minn.

[73] Assignee: Dur-A-Lift, Inc., George, Iowa

[21] Appl. No.: 381,758

[22] Filed: Feb. 1, 1995

[51] Int. Cl.[6] ..... B66C 23/42

[52] U.S. Cl. ..... 212/292; 212/300; 292/216; 403/322; 182/2

[58] Field of Search ..... 212/180, 181, 212/298, 299, 300, 292; 182/2; 403/321, 322, 323, 324, 325; 292/216

[56] References Cited

U.S. PATENT DOCUMENTS

| | | | |
|---|---|---|---|
| 1,955,969 | 4/1934 | Marzolf | 403/322 |
| 2,394,314 | 2/1946 | Le Tourneau | 212/300 |
| 2,699,314 | 1/1955 | Beale | 212/292 |
| 3,572,793 | 3/1971 | Cole | 292/216 |
| 4,303,165 | 12/1981 | Cassens et al. | 212/300 |
| 4,492,311 | 1/1985 | Rathe | 212/268 |
| 4,534,444 | 8/1985 | Smith | 182/2 |

OTHER PUBLICATIONS

Dur-A-Lift DFSL-37 Advertisement, 1988.
Dur-A-Lift UFN-32 Advertisement, 1984.

*Primary Examiner*—Karen B. Merritt
*Assistant Examiner*—Thomas J. Brahar
*Attorney, Agent, or Firm*—Kinney & Lange

[57] ABSTRACT

A boom assembly includes a boom arm movable away from and into a first position used for storage and transport of the boom assembly, and a boom latch positioned adjacent a free end of the boom arm when the boom arm is in the first position for restricting the movement of the boom arm out of the first position during transport of the boom assembly. The boom latch includes a lock member, a latch hook movable from a closed position wherein the lock member is retained in the latch hook to an open position wherein the lock member is not retained in the latch hook, and a latch hook control unit for alternately locking the latch hook in the closed position and unlocking the latch hook so that the latch hook is free to move from the closed position to the open position.

18 Claims, 4 Drawing Sheets

BOOM LATCH

BACKGROUND OF THE INVENTION

The present invention relates to an aerial lift which includes a boom assembly mounted to a transport vehicle and having an aerial bucket thereon. More particularly, the present invention relates to a mechanism for securing the boom assembly during transport.

Aerial lifts for use with vans, trucks and other vehicles typically include a boom assembly, an aerial bucket at a first end of the boom assembly for holding a person to be lifted, and a base unit mounted to the vehicle at a second end of the boom assembly. Boom assemblies generally include two separate boom arms and are generally available in one of two types: a telescoping assembly and an articulating assembly. In the telescoping boom assembly an upper boom is retracted into an opening of a hollow lower boom and then telescopingly extended therefrom for use. In the articulating boom assembly the upper boom is cradled on top of a lower boom in a storage position and then articulated to an extended position for use.

With both telescoping and articulated aerial lifts the booms are maintained in a generally horizontal position on the top of the vehicle during transport. Typically, a U-shaped cushioned bracket is used to maintain the upper boom in the cradled or retracted storage/transport position. The U-shaped bracket merely provides a resting surface for the upper boom and prevents the lateral movement of the boom during transport. One of the problems associated with such a mechanism is that the upper and lower booms bounce and shift within the U-shaped bracket during transport over rough road. In order to prevent this undesired movement it has been known to use a nylon strap and a hook assembly to secure the upper boom to the lower boom in an articulated assembly and to secure the upper boom to the vehicle in a telescoping assembly. This strap technique nonetheless requires substantial user time in securing and releasing the boom assembly.

SUMMARY OF THE INVENTION

The present invention relates to a boom assembly which includes a boom arm movable away from and into a first position for storage and transport of the boom assembly, and a boom latch positioned adjacent a free end of the boom arm when the boom arm is in the first position for restricting the movement of the boom arm out of the first position during transport of the boom assembly. The boom latch includes a lock member mountable on the boom arm, and a latch mechanism for engaging and retaining the lock member therein when the boom arm is in the storage transport position.

In one embodiment, the latch mechanism includes a latch hook movable from a locked position wherein the lock member is retained in the latch hook to an unlocked position wherein the lock member is not retained in the latch hook, and a latch hook control unit for controlling the locking and unlocking of the latch hook. The control unit provides that movement of the lock member into the latch mechanism automatically engages the lock member therein. Additionally, the control unit includes a reset mechanism for automatically resetting the latch mechanism in a position oriented to receive the lock member after the lock member is released therefrom.

DETAILED DESCRIPTION OF THE PREFERRED EMBODIMENTS

Figure 1:
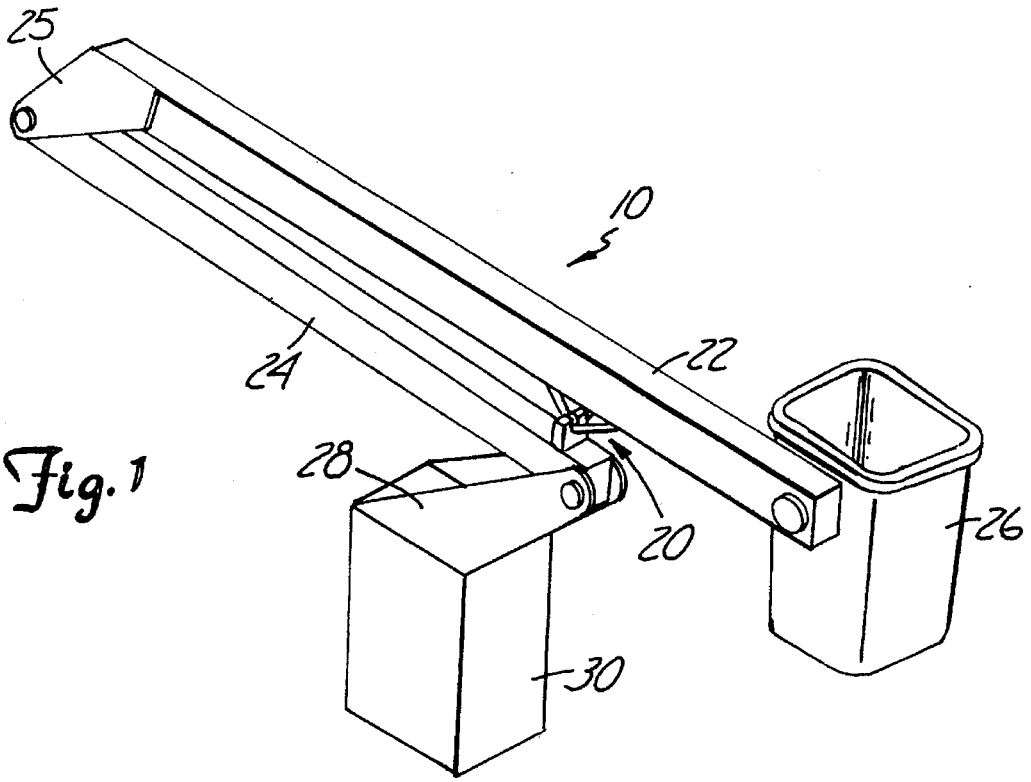
FIG. 1 is a perspective view of a boom assembly according to a first embodiment of the present invention.

FIG. 1 shows an aerial lift which incorporates an articulated boom assembly 10 utilizing a boom latch 20 in accordance with the present invention. The articulated boom assembly 10 includes an upper boom arm 22, a lower boom arm 24, an aerial lift bucket 26, a support arm 28, and a pedestal 30. The construction of the articulated boom assembly 10 is well known to those skilled in the art.

The support arm 28 is mounted for rotational movement in a conventional manner on the pedestal 30 which in turn is adapted for mounting on a transport vehicle (not shown). The support arm 28 is powered and controlled by conventional means (not shown) so as to provide swinging movement of the upper and lower booms 22 and 24. The upper and lower booms 22 and 24 are typically constructed of metal and are articulated together at an appropriate end section 25 thereof. The upper and lower booms 22 and 24 are also powered and controlled by conventional means (not shown) for movement of the lift bucket 26 from a storage/transport position wherein the upper and lower booms 22 and 24 are parallel to the vehicle to a use position wherein the lift bucket 26 is elevated above the vehicle. In the storage/transport position the upper boom 22 is cradled into the lower boom 24 and maintained in this position by the boom latch 20.

Figure 2:
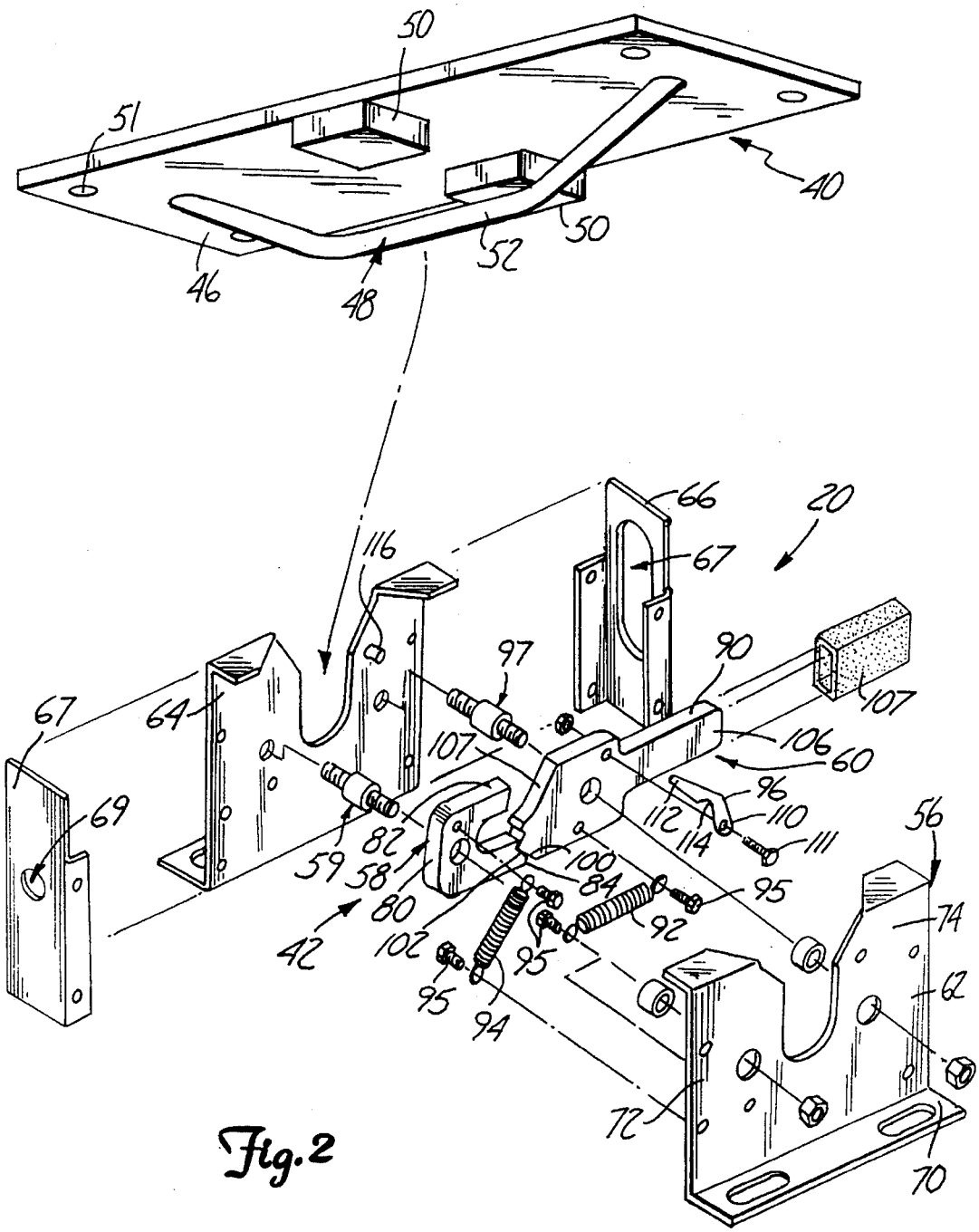
FIG. 2 is an exploited perspective view of the boom latch used in the boom assembly of FIG. 1 according to the present invention.

Referring to FIG. 2, the boom latch 20 includes a lock member 40 and a latch mechanism 42. The latch mechanism 42 is mounted to the lower boom 24 and provides the mechanism for securing and engaging the lock member 40 which is mounted on the upper boom 22. When the lock member 40 is secured within the latch mechanism 42, the boom latch 20 thereby restricts the undesired bouncing of the upper boom 22 during transport of the boom assembly 10.

The lock member 40 is mounted on an end the movable upper boom 22 opposite of the articulated end 25 thereof and is engaged with latch mechanism 42 only when the upper boom 22 is in the storage/transport position. The lock member 40 includes a base plate 46, an engaging section 48, and cushion pads 50. The base plate 46 includes mounting holes 51 and is mounted by bolts or other suitable securing mechanism (not shown) to the outer end of the upper boom arm 22 in a direction facing the lower boom arm 24. The engaging section 48 is a rod like member with the ends thereof welded to the base plate 46 such that a center portion 52 thereof is spaced apart from the base plate 46 for engaging or hooking into the latch mechanism 42. The cushion pads 50 are mounted to the base plate 46 on either side of the engaging section 48 to cushion the impact of the upper boom 22 when the lock member 40 is engaged with the latch mechanism 42.

The latch mechanism 42 includes a housing 56, a latch hook 58, and a latch hook control unit 60. The housing 56 is a hollow U-shaped member including a front plate 62, a back plate 64, and side plates 66 and 67. The front and back plates 62 and 64 are identical in construction and each includes a base section 70 mountable to the lower boom 24, a first extension 72 extending away from the base section 70 at one side thereof, and a second extension 74 extending away from the base section 70 from a side opposite of the first extension 72 to form an opening therebetween for receiving the center portion 52 of the lock member 40. The side plate 66 includes an opening 67 permitting the extension and movement of the latch hook control unit 60. The side plate 67 includes an entry hole 69 so as to permit access to a grease fitting (not shown) for the latch hook 58 for lubrication thereof.

The latch hook 58 is mounted within the housing 56 and is pivotal about a pin arrangement 59. The latch hook 58 is movable between a closed position (see FIG. 3B) wherein the lock member 40 is retained in the latch hook 58 so that the upper and lower booms 22 and 24 are maintained in their storage position, and an open position (see FIG. 3A) wherein the lock member 40 is not retained in a latch hook 58 so that the upper boom 22 is free to move with respect to the lower boom 24 and the vehicle. The latch hook 58 is U-shaped and includes a center section 80, a first arm 82, and a second arm 84. The first and second arms 82 and 84 extend from opposite sides of the center section 80 to form an opening therebetween. The center section 80 of the latch hook 58 is pivotally mounted about the pin arrangement 59 within the first extension 72 of the hollow U-shaped housing 56 such that the opening of the latch hook 58 is operable with the opening of the housing 56 for receiving the lock member 40 therein. When the latch hook 58 is in the closed position the first and second arms 82 and 84 of the latch hook 58 are maintained generally parallel to the length of the lower boom 24. The length of the first and second arms 82 and 84 is sufficient to extend across the opening of the housing 56 to retain the lock member 40 between the first and second arms 82 and 84 of the hook member and the second extension 74 of the housing 56. Upon upward pivoting of the latch hook 58, the lock member 40 is free to exist and enter through the opening of the housing 56.

The latch hook control unit 60 includes a latch arm 90, a first spring member 92, a second spring member 94, and a reset arm 96. The latch arm 90 is pivotally mounted about a pin arrangement 97 within the second extension 74 of the hollow U-shaped housing 56. A first end of the latch arm 90 includes intermeshing teeth 100 for engaging corresponding intermeshing teeth 102 on the second arm 84 of the latch hook 58 for maintaining the latch hook 58 in the closed position. The first end of the latch arm 90 also includes a convex surface 107 permitting movement of latch hook 58 between the open and closed positions when the latch arm is in the up position (see FIG. 3D). A second end of the latch arm 90 includes a handle 106 for movement of the latch arm 90 to release the intermeshed teeth 100 of the latch arm 90 from the intermeshed teeth 102 of the latch hook 58 to free the latch hook 58 and enable the latch hook 58 to pivot into the open position when the upper boom 22 is activated. A foam grip 107 is provided over the handle 106.

The first and second spring members 92 and 94 bias the latch hook 58 towards the open position. Upon movement of the handle 106 in an upward direction away from the lower boom 24, the intermeshed teeth 100 and 102 are released. Tension on the first and second spring members 92 and 94 then pivots the latch hook 58 upwards into the open position. The first spring member 92 is attached between the front plate 62 of the housing 56 and a lower portion of the latch arm 90. The second spring member 94 is attached between the front plate 62 of the housing 56 and an upper portion of the center section 80 of the latch hook 58 opposite the first spring member 92. The first and second spring members 92 and 94 are attached using bolts 95 or other well known fasteners.

The reset arm 96 resets the latch arm 90 in a position for engaging the latch hook 58 upon receipt of the lock member 40 in the latch hook 58 for storage and transport of the boom assembly 10. The reset arm 96 has a first end 110 pivotally attached to an upper portion of the latch arm 90, a second end 112 which extends into the opening in the U-shaped housing 56 when the latch hook 58 is in the closed position, and a hook section 114. The hook section 114 engages a housing pin 116 to maintain the latch arm 90 in the upward release position.

Figure 3A:
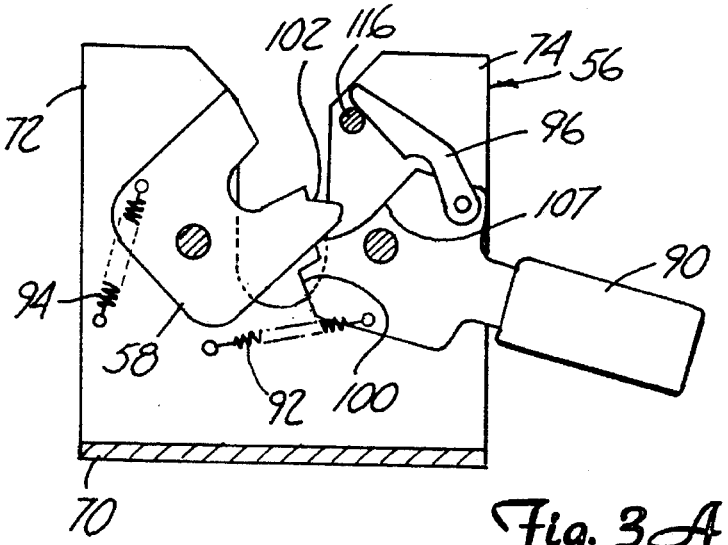
FIGS. 3A–3D are schematic diagrams of the boom latch showing a position of the components during operation.

The operation of the boom latch is shown in FIGS. 3A-3D. As shown in FIG. 3A, the latch mechanism 42 is in an unlocked and open position awaiting receipt of the lock member 40. More specifically, the latch arm 90 is in a down position and the latch hook 58 is maintained by the spring members 92 and 94 in the open position wherein the intermeshing teeth 100 and 102 are not engaged.

Figure 3B:
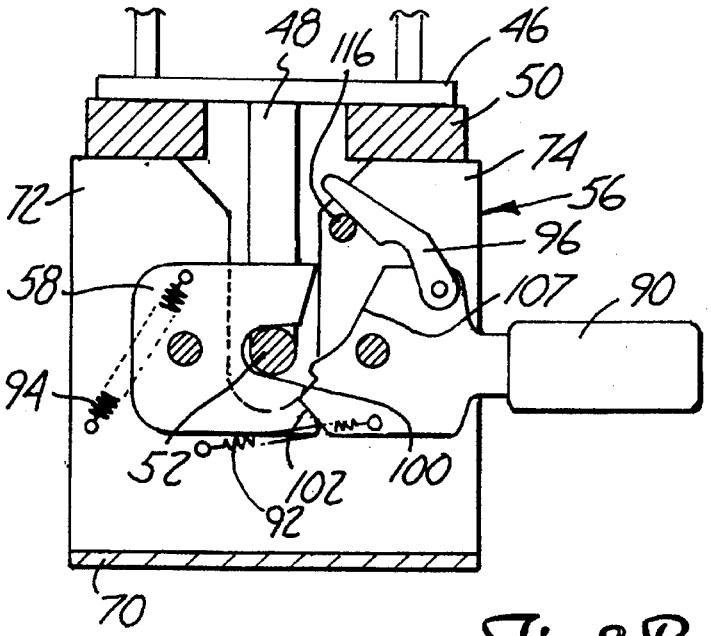

FIG. 3B shows the latch mechanism 42 in a locked and closed position wherein the lock member 40 is engaged therein. In this position, the engaging section 48 of the lock member is engaged in the latch hook 58. The intermeshing teeth 100 and 102 are engaged so that latch hook cannot pivot. The cushion pads 50 contact the housing 56 to prevent damage.

Figure 3C:
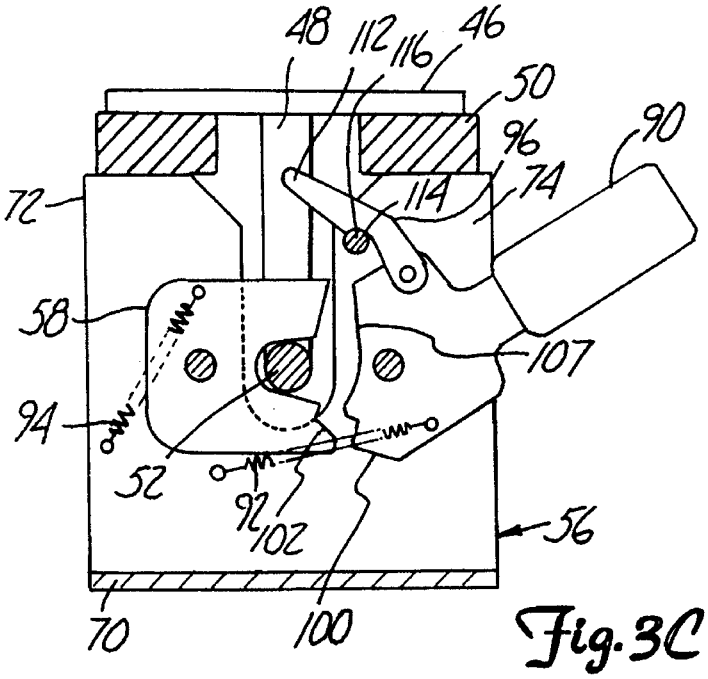
Figure 3D:
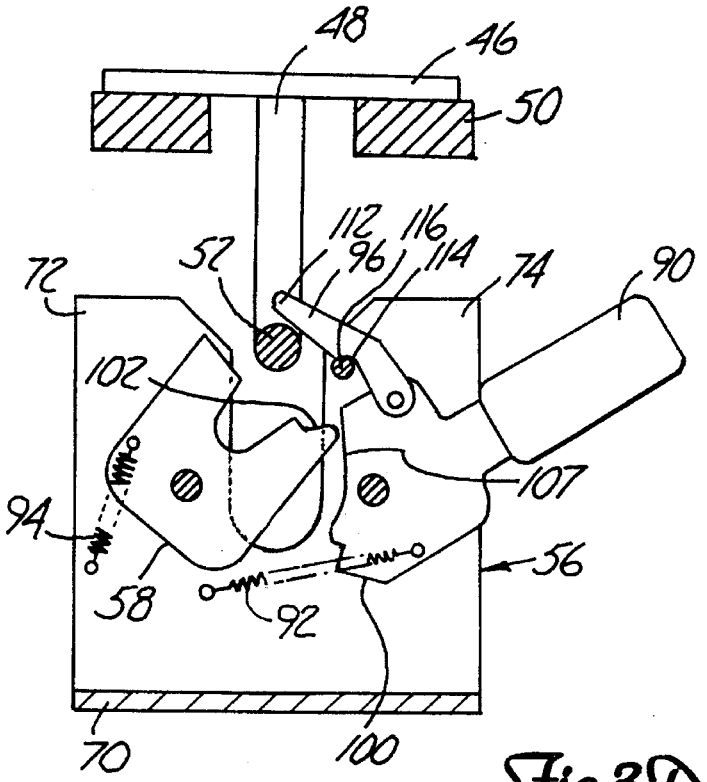

FIGS. 3C and 3D shows the release of the lock member 40 from the latch mechanism 42. In FIG. 3C, the operator has manually moved the latch arm 90 to an upward position so that the reset arm 96 is engaged with the housing pin 116. In this position, the latch arm 90 is not intermeshed with the latch hook 58, thereby enabling the latch hook 58 to pivot to the open position and release the lock member 40 upon activation of the boom assembly 10. In FIG. 3D, the upper boom 22 has been activated and the engaging section 48 moves out of the latch hook and contacts the second end 112 of the reset arm 96 which extends into the opening of the housing 56 thereby disengaging the hook section 114 from the housing pin 116. When the hook section 114 is disengaged, the spring member 92 returns the latch arm 90 to the down position so that the intermeshing teeth 100 of latch arm 90 are ready to engage the intermeshing teeth 102 of the latch hook upon a subsequent insertion of the lock member 40 therein. In other words, the lock mechanism 42 provides a automatic reset so that operator activity is minimized thereby saving time and effort in the securement of the boom assembly 10 during transport.

Figure 4:
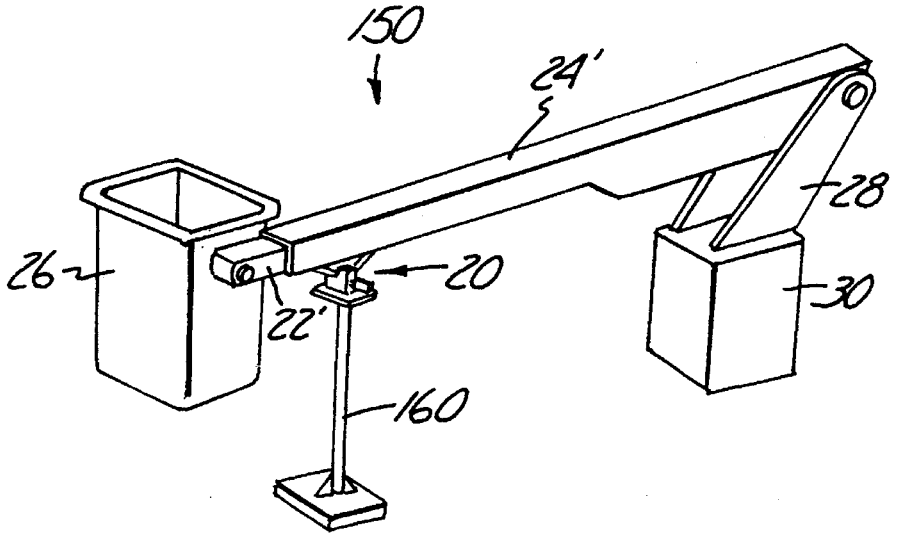
FIG. 4 is a perspective view of an alternate boom assembly in which the boom latch according to the present invention is incorporated.

FIG. 4 shows another embodiment of the arm aerial left which incorporates a telescoping boom assembly 150 utilizing the boom latch 20 in accordance with the present invention. The latecopying boom assembly 150 includes an upper boom arm 22; a lower boom arm 24; a pedestal 30, and a boom support cradle 150. The operation of boom latch 20 is the same as explained above with regard to the articulated boom assembly 10. The boom support cradle 160 merely provides a base for mounting the boom latch 20.

Although the present invention has been described with reference to preferred embodiments, workers skilled in the art will recognize that changes may be made in form and detail without departing from the spirit and scope of the invention.

What is claimed is:

1. A boom latch for securing a boom arm to a boom support such that the boom arm is maintained in a storage position adjacent the boom support, the boom latch comprising:

a lock member mountable on the boom arm; and a latch mechanism including:

a housing mountable on the boom support, the housing having an opening into which the lock member is inserted when the boom arm is in the storage position, and a pin adjacent the opening;

a latch hook mounted within the housing for engaging and retaining the lock member therein when the boom arm is in the storage position, the latch hook being pivotally movable between a first position where the lock member is retained therein, and a second position where the lock member is free to be removed therefrom or inserted therein:

a first biasing member for biasing the latch hook in its second position;

a latch arm pivotally mounted within the housing, the latch arm having an end which is intermeshable with an end of the latch hook, the latch arm being movable between a first position wherein the ends of the latch arm and latch hook are intermeshed for maintaining the latch hook locked in its first position, and a second position wherein the ends of the latch arm and the latch hook are not intermeshed permitting the latch hook to move to its second position;

a second biasing member for biasing the latch hook in its first position;

resetting and release member having a first end pivotally attached to the latch arm, a hook section for engaging the pin adjacent the opening to hold the latch arm in its second position to thereby permit release of the lock member from the latch hook, and a second end which is extendable into the opening of the housing so that when contacted by the lock member as the lock member is released from the latch hook, the hook section of the resetting and release member is disengaged from the pin, wherein the latch arm is reset to its first position.

2. The boom latch of claim 1, wherein movement of the lock member into the latch mechanism automatically engages the lock member therein.

3. The boom latch of claim 1, wherein the housing is a hollow U-shaped member including a base section mountable to the boom support, a first arm section and a second arm section each extending from an opposite side of the center section to form the opening therebetween for receiving the lock member.

4. The boom latch of claim 3, wherein the latch hook is U-shaped and includes a base center section and a pair of arm sections extending from opposite sides of the center section to form an opening, wherein the center section is pivotally mounted within the first arm section of the hollow U-shaped housing such that the opening of the latch hook is operable with the opening of the housing for retaining the lock member therein.

5. The boom latch of claim 4, wherein the latch arm is pivotally mounted within the second arm of the hollow U-shaped housing.

6. The boom latch of claim 1, wherein the first biasing member is a first spring member attached between the housing and the latch hook.

7. The boom latch of claim 6, wherein the second biasing member is a second spring member working in combination with the first spring member and is attached between the latch arm and the housing.

8. The boom latch of claim 1, wherein the latch arm includes a handle extending beyond the exterior of the housing for manually moving the latch arm from the first position to the second position.

9. A boom assembly comprising:

a boom arm movable away from and into a first position used for storage and transport of the boom assembly; and a boom latch positioned adjacent a free end of the boom arm when the boom arm is in the first position for restricting the movement of the boom arm out of the first position during transport of the boom assembly, the boom latch including:

a housing mountable on the boom support, the housing having an opening into which the lock member is inserted when the boom arm is in the storage position;

a latch hook mounted within the housing for engaging and retaining the lock member therein when the boom arm is in the storage position, the latch hook being pivotally movable between a first position where the lock member is retained therein, and a second position where the lock member is free to be removed therefrom or inserted therein;

a latch arm pivotally mounted within the housing, the latch arm having an end which is intermeshable with an end of the latch hook, the latch arm being movable between a first position wherein the ends of the latch arm and latch hook are intermeshed for maintaining the latch hook locked in its first position, and a second position wherein the ends of the latch arm and the latch hook are not intermeshed permitting the latch hook to move to its second position, wherein the latch arm includes a handle extending beyond an exterior surface of the housing such that the latch arm is manually movable from its first position to its second position.

10. The boom assembly of claim 9, wherein the latch mechanism includes reset means for resetting the latch hook in its second position and latch arm in its first position to receive and engage the lock member in the latch hook after the lock member has been removed from the latch mechanism.

11. The boom assembly of claim 10, wherein the reset means comprises:

a pin attached to the housing adjacent the opening; and a resetting and release member having a first end pivotally attached to the latch arm, a hook section for engaging the pin adjacent the opening to hold the latch arm in its second position to thereby permit release of the lock member from the latch hook, and a second end which is extendable into the opening of the housing so that when contacted by the lock member as the lock member is released from the latch hook, the hook section of the resetting and release member is disengaged from the pin, wherein the latch arm is reset to its first position.

12. The boom assembly of claim 11, further comprising a first spring member for biasing the latch hook in its second position.

13. The boom assembly of claim 12, wherein the first spring member is attached between the housing and an upper portion of the latch hook.

14. The boom assembly of claim 12, further comprising a second spring member working in combination with the first spring member for biasing the latch arm in its first position.

15. The boom assembly of claim 14, wherein the second spring member is attached between a lower portion of the latch arm and the housing.

16. The boom assembly of claim 9, wherein the housing is a hollow U-shaped member including a base section mountable to the boom support, a first arm section and a second arm section each extending from an opposite side of the center section to form the opening therebetween for receiving the lock member.

17. Boom assembly of claim 17, wherein the latch hook is U-shaped and includes a base center section and a pair of arm sections extending from opposite sides of the center section to form an opening, wherein the center section is pivotally mounted within the first arm section of the hollow U-shaped housing such that the opening of the latch hook is operable with the opening of the housing for retaining the lock member therein.

18. The boom assembly of claim 17, wherein the latch arm is pivotally mounted within the second arm of the hollow U-shaped housing.

* * * * *

UNITED STATES PATENT AND TRADEMARK OFFICE

CERTIFICATE OF CORRECTION

PATENT NO. :5,538,150

DATED :JULY 23, 1996

INVENTOR(S) MARK PERKINS

It is certified that error appears in the above-indentified patent and that said Letters Patent is hereby corrected as shown below:

Col. 5, line 18, after "therein", delete ":", insert --;--

Col. 5, line 32, before "resetting", insert --a--

Col. 7, line 10, after "claim", delete "17", insert --16--

Signed and Sealed this

Third Day of December, 1996

*Attest:*

Bruce Lehman

BRUCE LEHMAN

*Attesting Officer*

*Commissioner of Patents and Trademarks*